US005548853A

United States Patent [19]

Johnson

[11] Patent Number: 5,548,853

[45] Date of Patent: Aug. 27, 1996

[54] SHAMPOOING DEVICE

[76] Inventor: Loraine Johnson, 608 Woodpecker St., Baton Rouge, La. 70807

[21] Appl. No.: 371,421

[22] Filed: Jan. 11, 1995

[51] Int. Cl.[6] ..... A45D 44/10

[52] U.S. Cl. ..... 4/523

[58] Field of Search ..... 4/515–523, 572.1

[56] References Cited

U.S. PATENT DOCUMENTS

| | | | |
|---|---|---|---|
| 2,297,639 | 9/1942 | Thauwald | 4/520 |
| 2,351,849 | 6/1944 | Wells et al. | 4/520 |
| 3,449,771 | 6/1969 | Watson | 4/515 |
| 4,196,478 | 4/1980 | Cowell | 4/515 |
| 4,766,620 | 8/1988 | Boyhan | 4/516 |

*Primary Examiner*—Charles E. Phillips
*Attorney, Agent, or Firm*—Joseph N. Breaux

[57] ABSTRACT

A device for supporting the neck and back of a person over a water receiving receptacle, such as a sink, which has a lip defining a top opening and a substantially planar surface, such as a counter top, adjacent to the lip, is described. The device comprises: a wedge member having a base portion, a first inclined surface, and a second inclined surface.

15 Claims, 5 Drawing Sheets

SHAMPOOING DEVICE

BACKGROUND OF THE INVENTION

1. Field of the Invention

This invention relates generally to methods and devices used to support the neck and back of a person having his/her hair shampooed and, more specifically to methods and devices used to support the neck and back of a person having his/her hair shampooed over a sink having a counter top adjacent thereto.

2. Prior Art

It is often difficult and messy to shampoo the hair of a small child. It is known to shampoo a child's hair while the child is in a bathtub or while the child is leaning his head over a sink. Neither of these methods has been entirely satisfactory.

The bathtub method requires the person shampooing the child's hair to stoop or bend over which can be uncomfortable. In addition, the bathtub method requires that the child's entire body become wet. This can also be undesirable.

The conventional sink method generally requires that the child stand on a chair or other such support and lean forward over the sink while his/her hair is shampooed. This method, therefore, is not suitable for washing the hair of younger children who are unable to stand on their own. In addition, because the method requires the child to lean forward over the sink, the shampoo lather can get into the child's eyes, nose and mouth. This is uncomfortable and often terrifying to a child.

It would, therefore, be desirable to have a device and method that would allow a child's hair to be shampooed which would not require the person shampooing the hair to stoop or bend while the shampooing is performed. It would also be desirable to have a device and method which would allow a person to shampoo a child's hair over a sink or other water receiving receptacle which would not require the child to lean forward over the sink or receptacle. It would further be desirable to have a device which would position the child's head above and toward the center of the sink while at the same time supporting the child's neck and back.

SUMMARY OF THE INVENTION

Accordingly, it is an object of this invention to provide a device for supporting the neck and back of a child while the child's hair is being shampooed above a sink or other water receiving receptacle.

It is another object of this invention to provide a device which will reduce the quantity of water spilled onto adjacent counter tops and floors while shampooing the hair of a child above a sink or other water receiving receptacle.

It is another object of this invention to provide a device for supporting the neck and back of a child while the child's hair is being shampooed above a sink or other water receiving receptacle which allows the child to be secured to a stable surface while the child's hair is shampooed.

It is another object of this invention to provide a device for supporting the neck and back of a child while the child's hair is being shampooed above a sink or other water receiving receptacle which is comfortable for the child and easily used by the person shampooing the child's hair.

It is a further object of this invention to provide a device for supporting the neck and back of a child while the child's hair is being shampooed above a sink or other water receiving receptacle which provides storage compartments for the shampooing supplies used to shampoo the child's hair.

It is a further object of this invention to provide a method for shampooing a child's hair above a sink or other water receiving receptacle which is easy to practice and which will be comfortable for the child having his/her hair shampooed.

It is still a further object of this invention to provide a device and method for shampooing a child's hair above a sink or other water receiving receptacle which accomplishes some or all of the above objectives.

Accordingly, a device for supporting the neck and back of a person over a water receiving receptacle, such as a sink, which has a lip defining a top opening and a substantially planar surface, such as a counter top, adjacent to the lip, is described. The device comprises: a wedge member having a base portion, a first inclined surface, and a second inclined surface.

The base portion has at least one contact surface that is positionable on the substantially planar surface, such as a counter top, and a first edge portion positionable adjacent to the lip of the sink when the contact surface is positioned on the counter top.

The first inclined surface has a first and second end, the first end is in mechanical connection with the first edge portion of the base portion in a manner such that, when the first edge portion is positioned adjacent to the lip of the sink, the second end of the first inclined surface is positioned over and above the top opening of the sink or water receiving receptacle. The second end of the first inclined surface has a collar cavity formed therein for receiving and supporting the neck of the child.

The second inclined surface is positioned above the base portion and has a first connecting end in mechanical connection with the second edge of the first inclined surface. The second inclined surface includes a support surface that extends from the first connecting end in a direction away from the first inclined surface and toward the base portion. A towel channel is formed in the second inclined surface. The purpose of the towel channel is to receive at least a portion of a rolled towel. The towel channel is located on the second inclined surface at a location toward the first connecting end. The towel channel is oriented in a direction substantially parallel to an edge of the first connecting end.

The device may also include a flap attached to the wedge member to prevent water and/or shampoo from running onto the counter top during use. The flap may be attached to the wedge member in any manner that directs the water and shampoo, which runs down the first inclined surface during use, into the sink or water receiving receptacle.

The device may also include a cushion member. The cushion member is attachable to the support surface and cushions the back and shoulders of a person supported on the support surface during use of the device.

The device may also include a securing strap assembly. The securing strap assembly is attached to the wedge member and is used to secure a child onto the support surface when the child is having his/her hair shampooed.

The second inclined surface may incline from a plane defined by the contact surface of the base portion at an angle between five and thirty degrees.

The first inclined surface may incline from a plane defined by the contact surface of the base portion at an angle between forty-five and eighty-five degrees.

The support surface may be shaped to form first and second rail members. The first and second rail members are oriented in a direction substantially perpendicular to the direction of the towel channel. The purpose of the first and second rail members is to prevent a child from rolling off the support surface.

The wedge member may also include a compartment or compartments of a size sufficient to allow storage of shampooing supplies therein, and the base portion may be equipped with a suction cup or cups in order to more securely fasten the device to the counter top during use.

A method of shampooing a child's hair over a water receiving receptacle which has a lip defining a top opening and a substantially planar surface adjacent to the lip, is also provided.

The method comprises:

a) Providing a device for supporting the neck and back of a person over the water receiving receptacle that comprises:

a wedge member having a base portion, a first inclined surface, a second inclined surface and flap means, attached to the wedge member, for preventing water from running onto the substantially planar surface adjacent to the lip of the water receiving receptacle during use, the flap means is attached to the wedge member in a manner such that water running down the first inclined surface is directed into the water receiving receptacle;

the base portion having at least one contact surface positionable on the substantially planar surface and a first edge portion positionable adjacent to the lip when the contact surface is positioned on the substantially planar surface;

the first inclined surface having a first and second end, the first end being in mechanical connection with the first edge portion of the base portion in a manner such that, when the first edge portion is positioned adjacent to the lip, the second end of the first inclined surface is positioned over and above the top opening of the water receiving receptacle, the second end of the first inclined surface having a collar cavity means formed therein for receiving the neck of a person; and a second inclined surface, positioned above the base portion, having a first connecting end in mechanical connection with the second edge of the first inclined surface, the second inclined surface including a support surface extending from the first connecting end in a direction away from the first inclined surface and toward the base portion, the second inclined surface having formed therein a towel channel means for receiving at least a portion of a rolled towel, the towel channel means being located on the second inclined surface at a location toward the first connecting end and oriented in a direction substantially parallel to and edge of the first connecting end;

b) positioning the device onto the substantially planar surface adjacent to the opening in a manner such that the flap is within the opening;

c) installing a towel into the towel channel;

d) positioning the back and shoulders of a child onto the support surface in a manner such that the neck of the child is partially received within the collar cavity means; and e) shampooing the child's hair.

DETAILED DESCRIPTION OF PREFERRED EMBODIMENTS OF THE INVENTION

Figure 1:
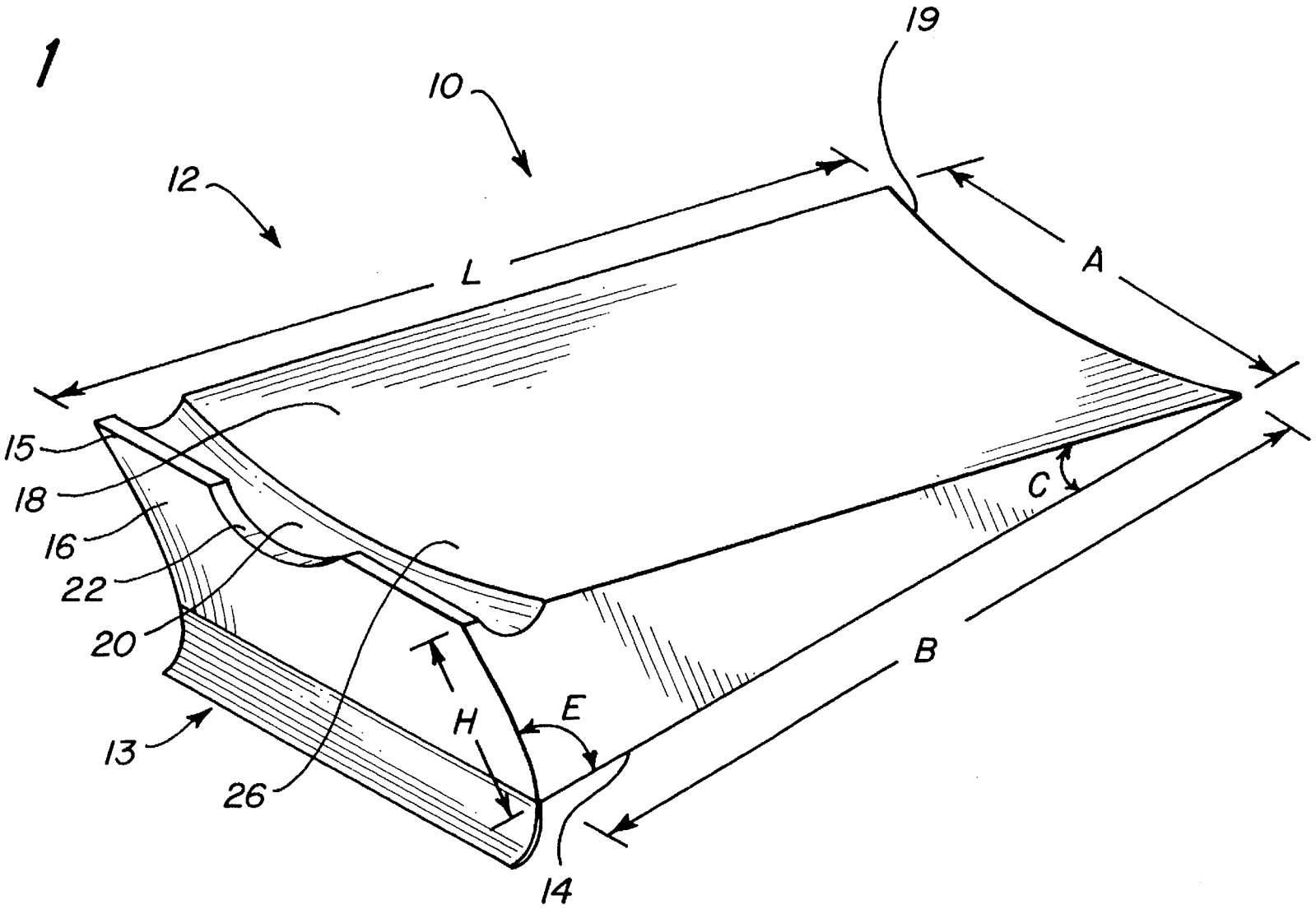
FIG. 1 is a perspective view of an embodiment of the device of the invention illustrating a preferred flap member.

FIG. 1 is a perspective view of a preferred embodiment of the shampooing device 10 of the present invention showing the wedge member, generally indicated by the numeral 12, and the flap member, generally indicated by the numeral 13.

Wedge member 12 comprises a base portion 14, a first inclined surface 16, a second inclined surface 18, a towel channel 20, and a collar cavity 22. Wedge member 12 may be constructed from any material which has sufficient rigidity to maintain the desired shape under a weight of about eighty pounds, however, it is preferred that wedge member 12 be formed from a plastic material such as polyvinyl chloride in order to keep the weight of the device to a minimum. In the preferred embodiment, base portion 14 of wedge member 12 would have a width "A" of about twenty-five centimeters, and a length "B" of about forty-five centimeters.

First inclined surface 16 will: be attached to an end of base portion 14 at an angle "E" of about one-hundred-thirty-five degrees; be of a length of about fifteen centimeters; and have an edge 15 that will extend past the lip of the sink approximately ten centimeters. As shown in the figure, first inclined surface 16 need not be planar.

Second inclined surface 18 will: taper upward from a second end 19 of base portion 14 at an angle "C" of about 15 degrees; be of a length "L" of about fifty six centimeters; and rise to a height "H" of about 12 centimeters above the counter top adjacent to the sink.

Figure 2:
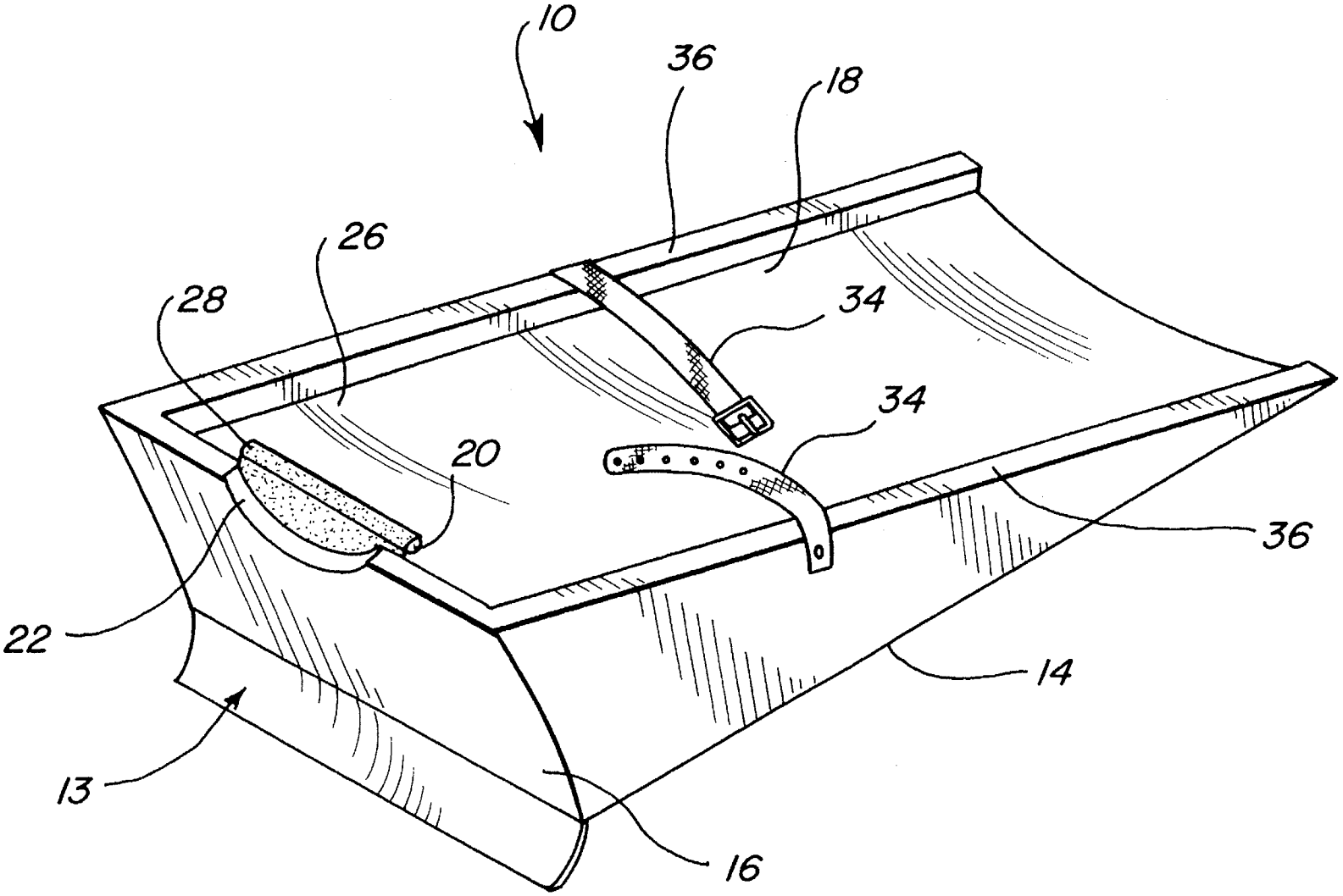
FIG. 2 is a perspective view of an embodiment of the device of the invention illustrating the function of the towel channel and showing a preferred securing strap arrangement.

Towel channel 20 is described with reference to FIGS. 1 and 2. FIG. 1 shows towel channel 20 formed on second inclined surface 18 adjacent to a support surface 26 and a collar cavity 22. Towel channel 20 may be formed across the entire width of second inclined surface 18 and have a depth sufficient to allow a hand towel which has been rolled up along its length, to be partially set therein as shown in FIG. 1. The towel channel 20 may also be formed adjacent collar 22 and extend a distance coinciding with the length of collar 22 as shown in FIG. 2. The function of towel channel 20 is more clearly described with reference to FIG. 2 which shows a hand towel 28 rolled and in place in towel channel 20. When hand towel 28 is installed in towel channel 20, hand towel 28 will act as a moisture barrier to prevent water from traveling from collar cavity 22 down support surface 26 and will act as a cushioning surface to the neck of a child having his/her hair shampooed.

Collar cavity 22 is also shown in FIG. 2. Collar cavity 22 is sized to allow the neck of a child to fit comfortably therein when the child is laying on his/her back on support surface 26.

As seen in FIG. 2, a securing strap 34 that is securable across support surface 26 will be included in this preferred embodiment. Securing strap 34 will allow the person shampooing the child's hair to secure the child to support surface 26 and prevent the child from rolling off the sides of support surface 26. In addition, the embodiment shown in FIG. 2 includes two rail members 36 adjacent to the sides of support surface 26.

Also shown in FIGS. 1 and 2 is a preferred flap member 13. In the preferred embodiment, flap member 13 will be constructed of a length of flexible rubber about twenty-five centimeters long and about five centimeters wide. Although it is preferred that flap member 13 be constructed of a flexible material, it would also be desirable to form flap member 14 integrally with first inclined surface 16 or base portion 14 using the same material of which they are formed. The purpose of flap member 13 is to prevent water and soap from seeping under base portion 14 when the device is in use.

Figure 4:
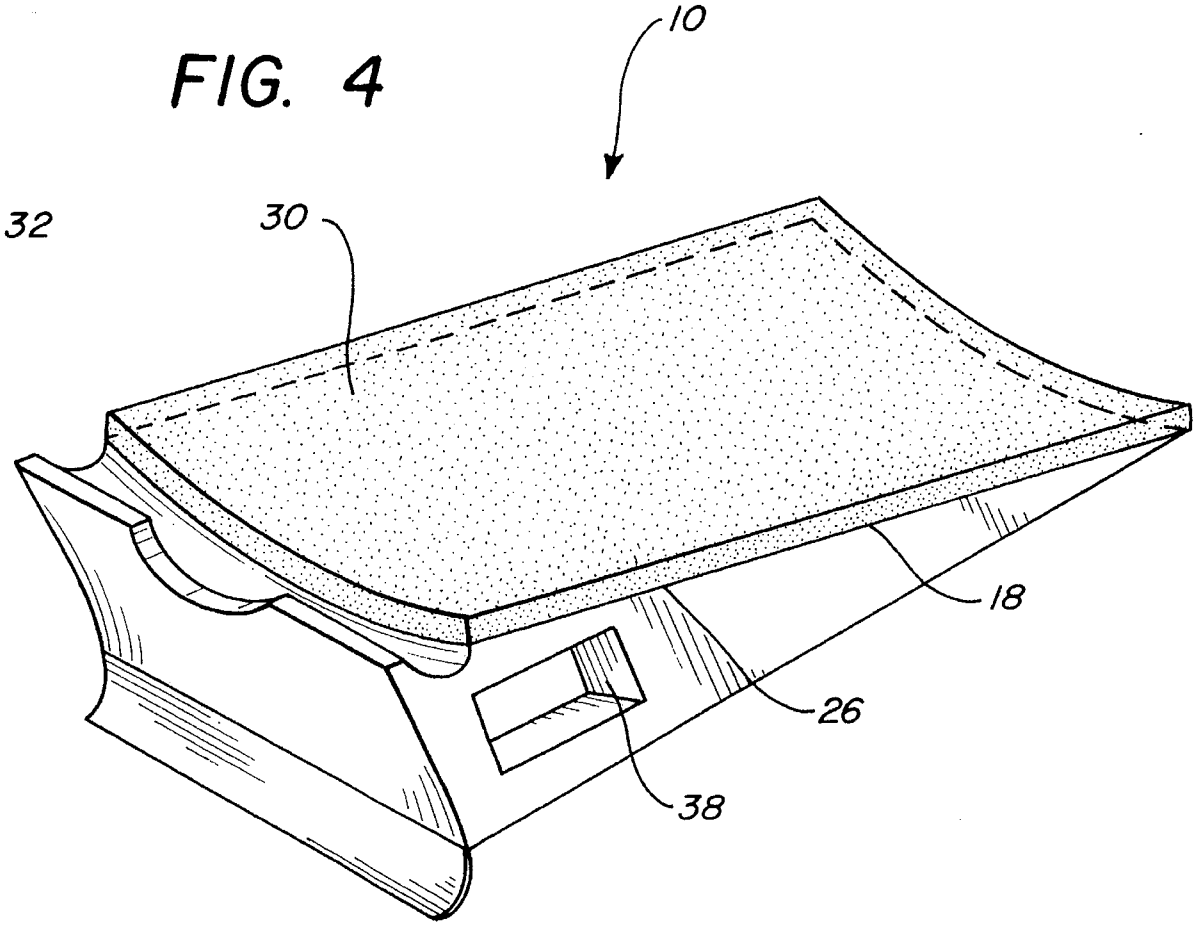
FIG. 4 is a perspective view of an embodiment of the device of the invention illustrating a preferred cushion member in connection with the wedge member and a preferred storage compartment placement.
Figure 3:
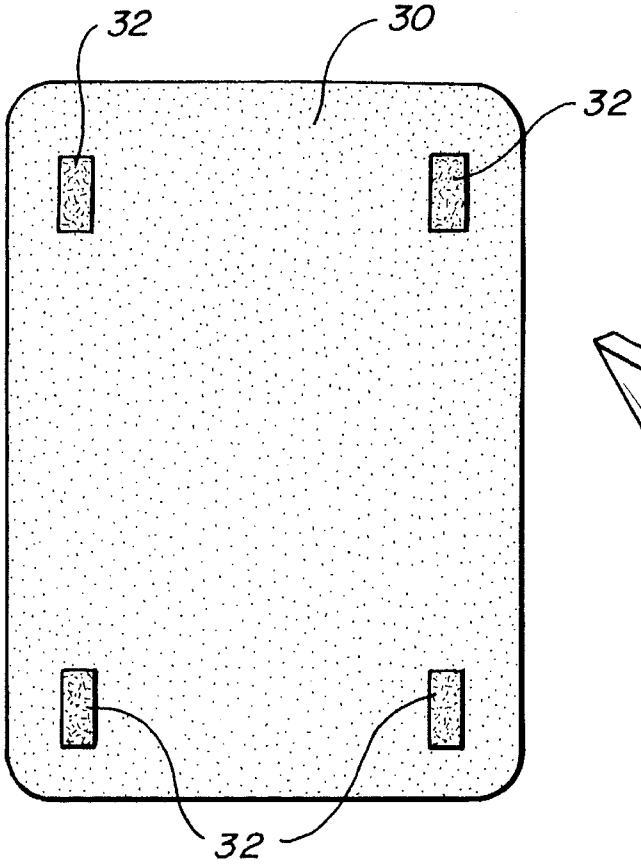
FIG. 3 is a schematic view of the underside of a preferred cushion member.

A cushion 30, such as shown in FIGS. 3 and 4, will also be included with the preferred embodiment of device 10. Cushion 30 will be detachably secured to support surface 26 of second inclined surface 18 by any method known in the art, however it is desired to make the attachment with a number of hook and pile type fasteners 32. The detachability of cushion 30 allows for laundering of the cushion and will facilitate cleaning of support surface 26 when necessary.

FIG. 4 also shows a storage compartment 38, which will be provided in the preferred embodiment for conveniently storing the shampooing supplies required for shampooing a child's hair.

Figure 5:
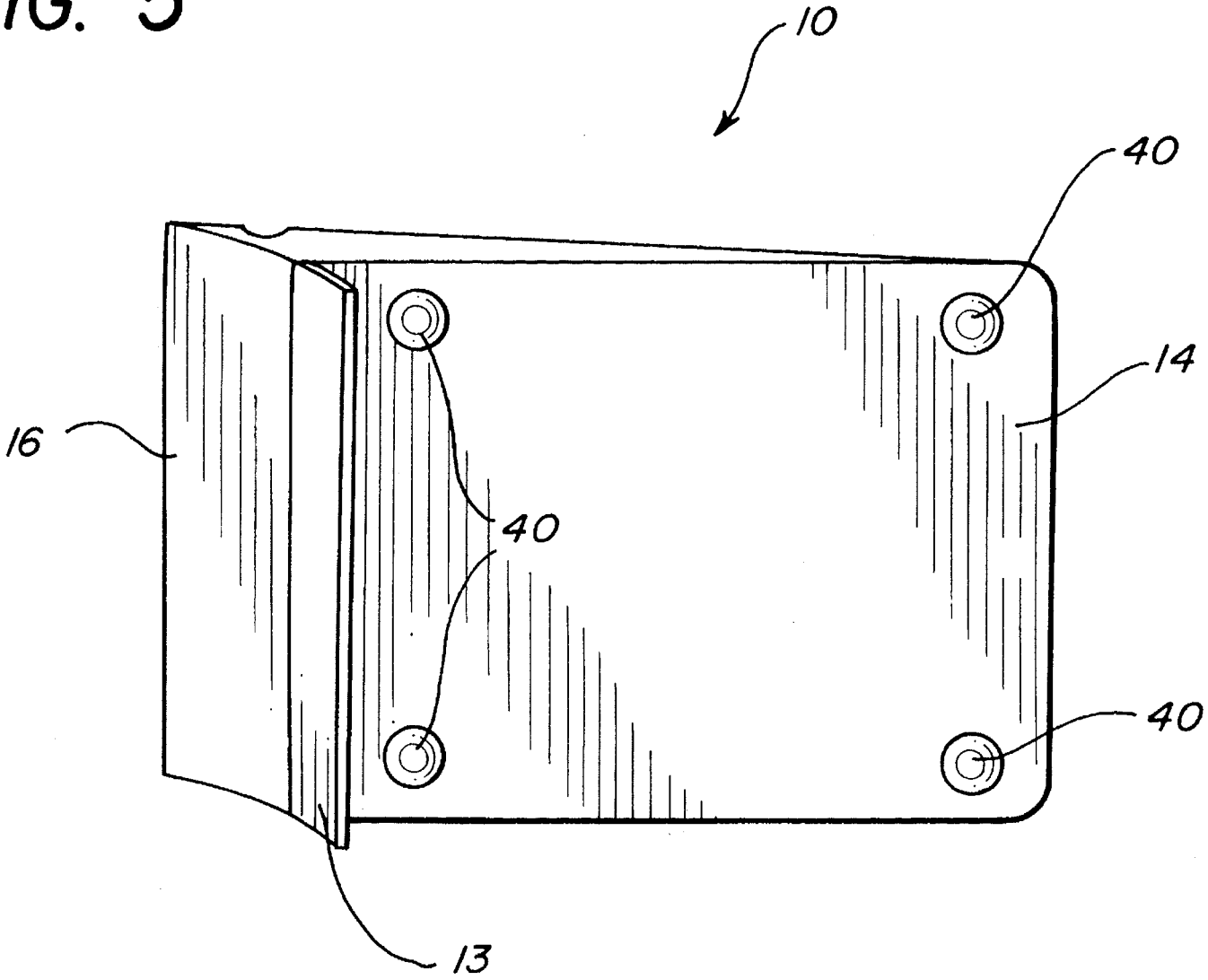
FIG. 5 is a perspective view from the underside of the device showing the base portion and a preferred suction cup configuration.

FIG. 5 shows the under side of device 10 and more clearly shows the base portion 14. As can be seen in the figure, this preferred embodiment will include a plurality of suction cups 40 attached to base portion 14. Suction cups 40 will allow the user to more securely attach device 10 to the counter top adjacent to the sink during use.

DETAILED DESCRIPTION OF A PREFERRED METHOD OF SHAMPOOING A CHILD'S HAIR.

Figure 6:
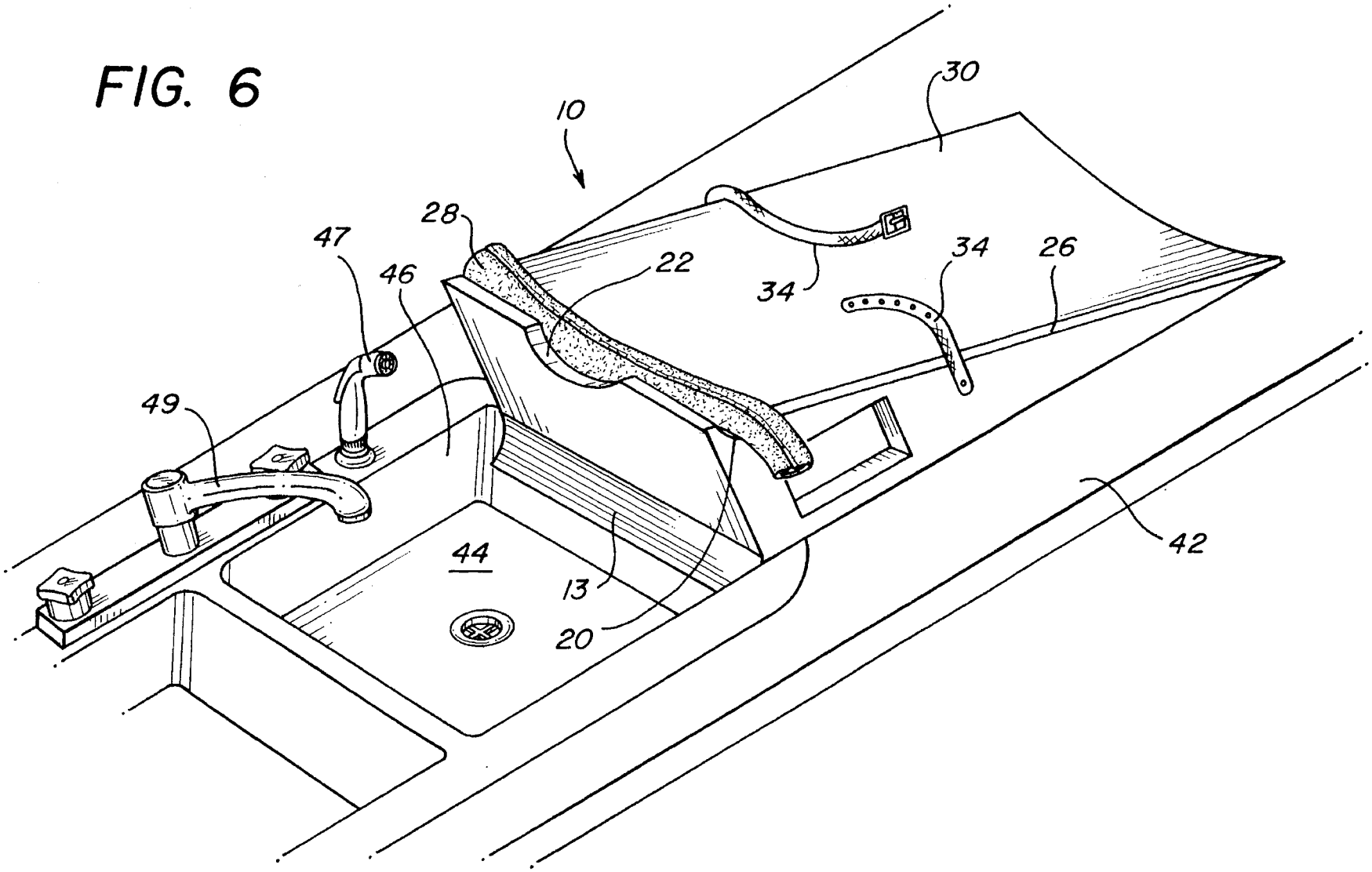
FIG. 6 is a perspective view of an embodiment of the invention positioned for use on a counter top adjacent to a typical sink.

The following discussion of a preferred method of shampooing a child's hair will be with reference to FIG. 6. The method used is simple and easily performed. The method comprises providing an embodiment of device 10; positioning device 10 onto a counter top 42 adjacent to the opening 44 in the sink 46 in a manner such that flap 13 is within opening 44 of Slink 46; installing a towel 28 into towel channel 20; positioning the back and shoulders of the child onto support surface 26 in a manner such that the neck of the child is partially received within collar 22, and then shampooing the child's hair. Water for the shampooing can be provided from either or both the flexible sprinkle nozzle 47 or the conventional spigot 49.

In a preferred embodiment of the method, a cushion 30 may be secured to support surface 26 prior to positioning the back and shoulders of the child onto cushion 30 which is supported by support surface 26.

In another preferred embodiment of the method, the child may be secured to the support surface 26 using strap assembly 34 after performing the step of positioning the back and shoulders of the child onto support surface 26.

Upon a review of the disclosure contained herein, other embodiments of the invention may occur to those skilled in the art, and such embodiments are intended to be included within the scope and spirit of the following claims.

What is claimed is:

1. A device for supporting the neck and back of a person over a water receiving receptacle which has a lip defining a top opening and a substantially planar surface adjacent, to said lip, said device comprising:

a wedge member having a base portion, a first inclined surface, and a second inclined surface;

said base portion having at least one contact surface positionable on said substantially planar surface and a first edge portion positionable adjacent to said lip when said contact surface is positioned on said substantially planar surface;

said first inclined surface having a first and second end, said first end being in mechanical connection with said first edge portion of said base portion in a manner such that, when said first edge portion is positioned adjacent to said lip, said second end of said first inclined surface is positioned over and above said top opening of said water receiving receptacle, said second end of said first inclined surface having a collar cavity means formed therein for receiving the neck of a person; and a second inclined surface, positioned above said base portion, having a first connecting end in mechanical connection with said second edge of said first inclined surface, said second inclined surface including a support surface extending from said first connecting end in a direction away from said first inclined surface and toward said base portion, said second inclined surface having formed therein a towel channel means for receiving at least a portion of a rolled towel, said towel channel means being located on said second inclined surface at a location toward said first connecting end and oriented in a direction substantially parallel to and edge of said first connecting end.

2. The device of claim 1 further including flap means, attached to said wedge member, for preventing water from running onto said substantially planar surface adjacent to said lip of said water receiving receptacle during use, said flap means being attached to said wedge member in a manner such that water running down said first inclined surface is directed into said water receiving receptacle.

3. The device of claim 1 further including cushion means, attachable to said support surface, for cushioning the back and shoulders of a person being supported by said support surface during use of said device.

4. The device of claim 1 further including securing strap means, attached to said wedge member, for securing a child onto said support surface.

5. The device of claim 1 wherein said second inclined surface inclines from a plane defined by said contact surface of said base portion at an angle between five and thirty degrees.

6. The device of claim 1 wherein said first inclined surface inclines from a plane defined by said contact surface of said base portion at an angle between one-hundred-five and one-hundred-thirty degrees.

7. The device of claim 1 wherein said support surface is shaped to form first and second edge members, said first and second edge members being oriented in a direction substantially perpendicular to the direction of said towel channel means.

8. The device of claim 1 wherein said wedge member includes compartments of a size sufficient to allow storage of shampooing supplies therein.

9. The device of claim 1 wherein said base portion has attached thereto at least one suction cup means for detachably securing said wedge portion to said substantially planar surface.

10. A device for supporting the neck and back of a person over a water receiving receptacle which has a lip defining a top opening and a substantially planar surface adjacent to said lip, said device comprising:

a) a wedge member having a base portion, a first inclined surface, and a second inclined surface;

said base portion having at least one contact surface positionable on said substantially planar surface and a first edge portion positionable adjacent to said lip when said contact surface is positioned on said substantially planar surface;

said first inclined surface having a first and second end, said first end being in mechanical connection with said first edge portion of said base portion in a manner such that, when said first edge portion is positioned adjacent to said lip, said second end of said first inclined surface is positioned over and above said top opening of said water receiving receptacle, said second end of said first inclined surface having a collar cavity means formed therein for receiving the neck of a person;

a second inclined surface, positioned above said base portion, having a first connecting end in mechanical connection with said second edge of said first inclined surface, said second inclined surface including a support surface extending from said first connecting end in a direction away from said first inclined surface and toward said base portion, said second inclined surface having formed therein a towel channel means for receiving at least a portion of a rolled towel, said towel channel means being located on said second inclined surface at a location toward said first connecting end and oriented in a direction substantially parallel to and edge of said first connecting end; and b) flap means, attached to said wedge member, for preventing water from running onto said substantially planar surface adjacent to said lip of said water receiving receptacle during use, said flap means being attached to said wedge member in a manner such that water running down said first inclined surface is directed into said water receiving receptacle.

11. The device of claim 10 further including cushion means, attachable to said support surface, for cushioning the back and shoulders of a person being supported by said support surface during use of said device.

12. The device of claim 11 further including securing strap means, attached to said wedge member, for securing a child onto said support surface.

13. The device of claim 12 wherein said support surface is shaped to form first and second edge members, said first and second edge members being oriented in a direction substantially perpendicular to the direction of said towel channel means.

14. The device of claim 13 wherein said wedge member includes compartments of a size sufficient to allow storage of shampooing supplies therein.

15. The device of claim 14 wherein said base portion has attached thereto at least one suction cup means for detachably securing said wedge portion to said substantially planar surface.

* * * * *